US009241519B2

(12) United States Patent
Jaeger

(10) Patent No.: US 9,241,519 B2
(45) Date of Patent: Jan. 26, 2016

(54) GLOVE FOR USE IN THE OIL AND NATURAL GAS EXTRACTION INDUSTRIES

(75) Inventor: Eric M. Jaeger, El Segundo, CA (US)

(73) Assignee: Ironclad Performance Wear Corporation, Farmers Branch, TX (US)

( * ) Notice: Subject to any disclaimer, the term of this patent is extended or adjusted under 35 U.S.C. 154(b) by 957 days.

(21) Appl. No.: 12/284,256

(22) Filed: Sep. 19, 2008

(65) Prior Publication Data

US 2010/0071114 A1 Mar. 25, 2010

(51) Int. Cl.
*A41D 19/015* (2006.01)

(52) U.S. Cl.
CPC ..... *A41D 19/01523* (2013.01)

(58) Field of Classification Search
CPC ..... A41D 19/01523
USPC ..... 2/16, 20, 161.6, 163
See application file for complete search history.

(56) References Cited

U.S. PATENT DOCUMENTS

| | | | | |
|---|---|---|---|---|
| 3,882,548 | A * | 5/1975 | Shinagawa et al. | 2/20 |
| 4,272,849 | A | 6/1981 | Thurston et al. | |
| 4,484,359 | A | 11/1984 | Tirinen | |
| 4,570,269 | A * | 2/1986 | Berlese | 2/16 |
| 4,663,783 | A * | 5/1987 | Obayashi | 2/161.1 |
| 4,757,555 | A * | 7/1988 | Gold | 2/16 |
| 4,766,612 | A * | 8/1988 | Patton, Sr. | 2/16 |
| 4,768,234 | A * | 9/1988 | Yamamoto | 2/16 |
| 7,320,145 | B2 * | 1/2008 | Hochmuth | 2/161.1 |
| 7,406,719 | B2 * | 8/2008 | Aoki | 2/161.1 |
| 7,694,351 | B2 | 4/2010 | Gait | |
| 2002/0184696 | A1 | 12/2002 | Hochmuth | |
| 2007/0029690 | A1 * | 2/2007 | Green et al. | 264/50 |
| 2007/0220655 | A1 | 9/2007 | Aoki | |

FOREIGN PATENT DOCUMENTS

| | | | |
|---|---|---|---|
| DE | 41 33 178 | A1 | 4/1993 |
| GB | 2 378 890 | A | 2/2003 |
| WO | 2005/065789 | A1 | 7/2005 |

OTHER PUBLICATIONS

European Patent Office, "Extended European Search Report", received for European Patent Appl. No. 09814173.2, which is a European counterpart of U.S. Appl. No. 12/284,256, filed Oct. 10, 2014.

IP Australia, "Examination Report No. 1", received for Australian Patent Appl. No. 2009294212, which is Australian counterpart of U.S. Appl. No. 12/284,256, filed Mar. 13, 2014.

Ironclad Performance Wear Corp., Response to the Communication of Oct. 22, 2014 for European Patent Application No. 09 814 173.2, submitted to European Patent Office on May 6, 2015, 18 pages.

* cited by examiner

*Primary Examiner* — Katherine Moran
(74) *Attorney, Agent, or Firm* — Amster, Rothstein & Ebenstein, LLP

(57) ABSTRACT

A safety glove for use in the oil and natural gas extraction industries whereas a unique design on the dorsal portion of the glove is provided, the dorsal portion comprising a plurality of raised protective members extending substantially along the entire length of the finger and thumb portions of the glove.

9 Claims, 4 Drawing Sheets

GLOVE FOR USE IN THE OIL AND NATURAL GAS EXTRACTION INDUSTRIES

BACKGROUND OF THE INVENTION

1. Field of the Invention

The present invention provides a glove construction particularly adapted to protect the hands and fingers of workers in the oil and natural gas extraction industries.

2. Description of the Prior Art

Workers in the oil and gas extraction industry often handle large pipes and heavy tools, such as steel wrenches. These items are typically handled in the presence of mud, crude oil, lubricating fluids such as a mixture of diesel fuel and mud, and other natural and synthetic lubricants. These lubricants assist in drilling for and extracting petrochemical compounds. The difficulty of gripping pipes and tools in the presence of such lubricants creates a working environment susceptible to impacts occurring to the dorsal, or back, side of the hand. These impacts have historically resulted in a large number of hand injuries to workers. The injuries are typically expressed as simple or hairline fractures to the following group of bones: metacarpals, proximal phalanges, intermediate phalanges, are distal phalanges; injuries can also occur to the distal interphalangeal joints, the proximal interpalangeal joints and the metacarpophalangeal joints.

Gloves typically used in oil and gas extraction are common knit gloves with raised polymer dots on the palm side. Although these gloves provide a grip function, they have a short lifespan and lack protection from dorsal impacts.

Recently, several companies have developed fitted gloves for sport or work with molded polymer rubber elements on the dorsal side. These gloves, however, are not optimized for impact protection to selected bones and joints. Further, the gloves are not optimized for impact protection to the entire nail bed of the fingernails.

Sport gloves for goalies in the sports of soccer, lacrosse and hockey have dorsal hand protection provided by segmented thick foam padding on the dorsal side of the glove. However, the gloves are not optimized for the dexterity required by oil and gas extraction workers and have no protection for the hand joints noted above. The foam padding does not taper at the distal phalanges and is not designed to protect against sharp blows from metal objects. Fitted gloves for sport or work consist of one or more molded plastic or carbon fiber elements located over the metacarpophalangeal joints but do not protect other hand joints or substantial protection of the above-listed bones.

What is desired is to provide a glove for use in the oil industry and natural gas extraction industries which protects the back portion of the worker's hand while maintaining a high level of hand dexterity.

SUMMARY OF THE INVENTION

The present invention provides a glove construction designed to reduce the occurrence of injuries to the back of the hand of workers in the oil and natural gas industries. This is accomplished by protecting certain bones and their associated joints during impact to the back of the hand with protective elements located on the dorsal (back) side of a glove (or mitten) over the metacarpals, proximal phalanges, intermediate phalanges, and distal phalanges. The protective elements may also be located over the distal interphalangeal joints, the proximal interphalangeal joints and the metacarpophalangeal joints.

The glove of the present invention maximizes dorsal impact protection while maintaining a high level of hand dexterity. Interference from tools and handled materials is reduced while hand flexibility is maintained, allowing full manipulation of tools and materials. The glove back comprises multiple protective elements generally located over the metacarpals, proximal phalanges, intermediate phalanges, and distal phalanges; the distal interphalangeal joints, the proximal interphalangeal joints and the metacarpophalangeal joints. The protective elements are raised above the surface of the glove fabric; and at the distal phalanges, preferably extend laterally to cover the entire nail bed of the wearer's fingernails.

The protective elements preferably slop laterally at distal phalanges to each side, reducing interference with adjacent phalanges (the protective elements preferably slope laterally at all phalanges). The protective elements having a width less than the fabric beneath the elements so that the fabric can stretch as the hand and fingers of the wearer are flexed in order to increase the comfort and fit of the glove.

DESCRIPTION OF THE DRAWINGS

For a better understanding of the present invention as well as other objects and further features thereof, reference is made to the following description which is to be read in conjunction with the accompanying drawing wherein.

DESCRIPTION OF THE INVENTION

Figure 1:
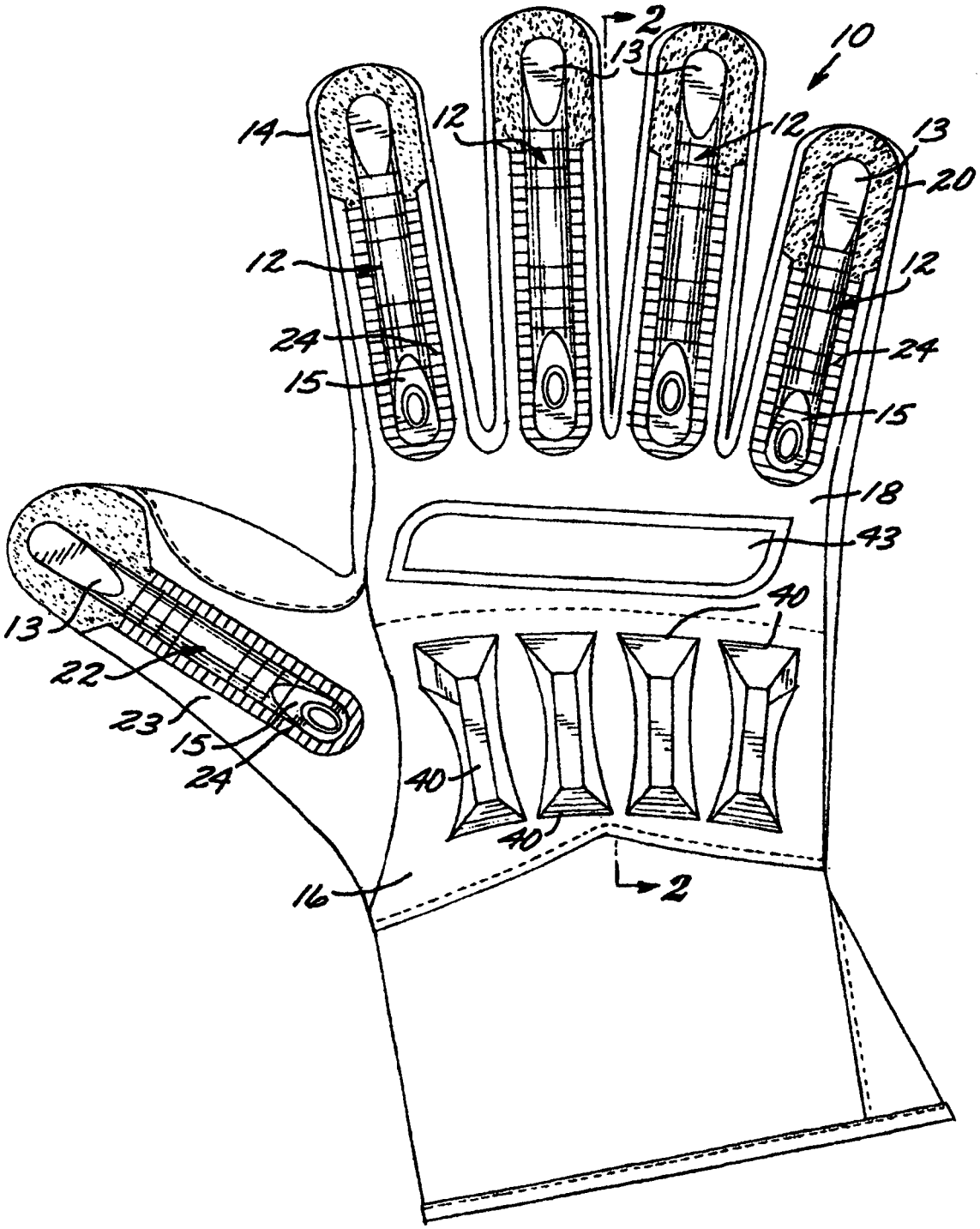
FIG. 1 is a top plan view of the dorsal side of the glove of the present invention.

Referring now to FIG. 1, a plan view of the dorsal side of glove 10 is illustrated.

It should be noted that identical reference numerals in the figures refer to the same element.

The dorsal (back) side of glove 10 comprises a plurality of protective members 12 secured to fingers 14, 16, 18 and 20, and protective member 22 secured to thumb portion 23. The elongated and raised protective members 12 and 22 are fixed to a rubber base 24 member which, in turn, is fixed to the glove fabric on the corresponding finger/thumb portion. Member 12 and 22 have a front sloped portion 13, segmented portions 17 (FIG. 2) and back sloped portion 15. Base member 24 includes portion 25 to provide additional protection to the sides of the wearer's distal bones.

The protective members 12 is located substantially over the corresponding proximal phalanx, intermediate (or middle) phalanx, and distal phalanx finger bones of the wearer. Protective members 12 overlays the distal interphalangeal joints and the proximal inter phalangeal joints of the finger bones.

The protective member 22 is located substantially over the corresponding metacarpal, proximal phalanx, and distal phalanx thumb bones of the wearer. Protective member 22 also overlays the distal interphalangeal joint and the metacarpophalangeal joint of the thumb bones. Members 40 are located over the metacarpals of the finger bones and element 43 is located over the metacarpophalangeal joints of the finger bones, providing additional protection to the back hand of the wearer.

Protective members 12, 22, 40 and 43 are raised above the glove dorsal surface 16 to further reduce the force of impacts and have a height in the range between 2 mm and 15 mm. The glove material 18 beneath protective members 12, 22, 40 and 43 preferably comprises knitted, flexible fabric.

In a first alternate glove construction, the protective members are located substantially over each of the metacarpals, proximal phalanges, intermediate phalanges, and distal phalanges of four digits, excluding the thumb. In a second alternate glove construction, the protective members are located substantially over each of the metacarpals, proximal phalanges, intermediate phalanges, and distal phalanges of four digits, excluding the thumb, and protective elements located substantially over the proximal phalange and distal phalange of the thumb.

Protective members 12, 22, 40 and 43 are formed to specific shapes to increase flexibility, protection and dexterity and are formed to specific shapes via thermal molding/casting. The portions 13 of protective members 12 and 22 slope downward at the distal phalanges toward the distal region (tip) of fingers to reduce interference or snagging from tools or materials being manipulated. In addition, portions 13 at distal phalanges extend laterally such that they cover the entire nail bed of the wearer. The portions 25 of protective members 12 and 22 at distal phalanges also slope laterally to each side to reduce interference with adjacent phalanges (note that other portions of the protective members 12 and 22 may slope laterally at all phalanges). Protective members 12 and 22 are preferably designed such that their width is less than the width of the fabric 18 beneath the member so that the fabric can stretch as the thumb and fingers of the wearer are flexed while also increasing the comfort and fit of glove 10.

The protective members 12 and 22 comprise a plurality of segments 17 (shown in FIGS. 2 and 3) to increase flexibility, the segmentation including partial voids, or gaps, 19 to maintain overall strength and adhesion to the substrate material. The segmentation is located at the distal interphalangeal joints and the proximal interphalangeal joints of the finger bones, and the metacarpophalangeal joint of the thumb bones. The spacing between adjacent segments are preferably in the range between 0.5 mm and 4 mm.

Figure 2:
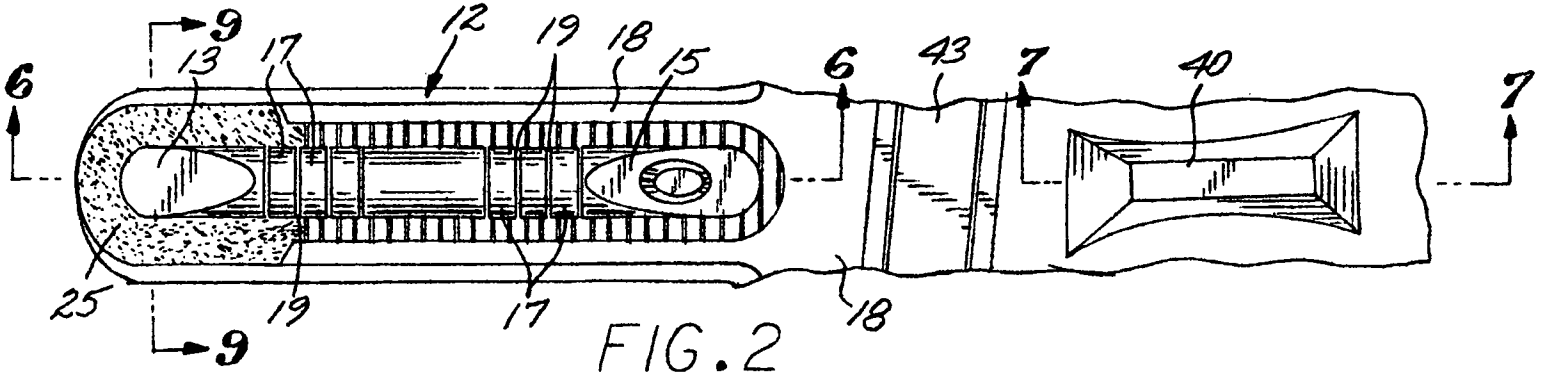
FIG. 2 is an enlarged top plan view of one finger of the glove shown in FIG. 1.
Figure 3:
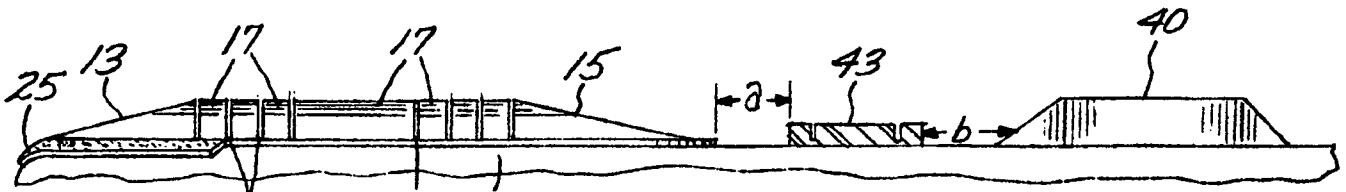
FIG. 3 is a side plan view of the finger shown in FIG. 2.
Figure 5:
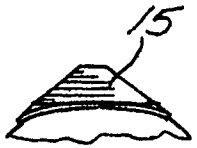
FIG. 5 is a rear plan view of the finger shown in FIG. 2.
Figure 4:
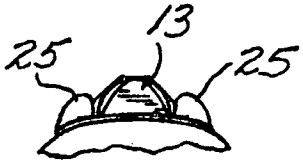
FIG. 4 is a front plan view of the finger shown in FIG. 2.
Figure 6:
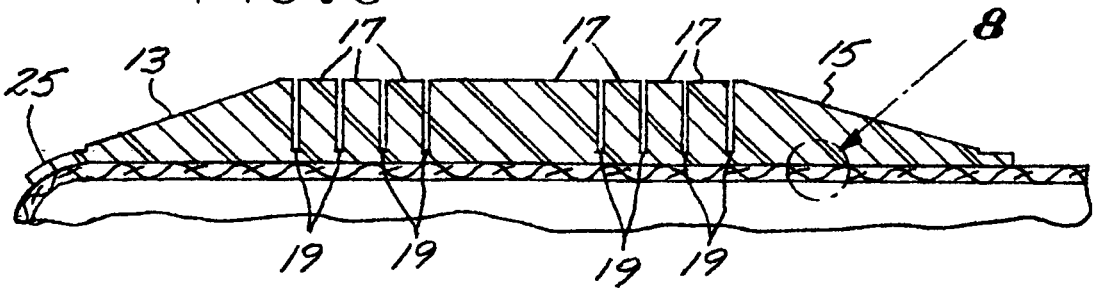
FIG. 6 is a cross-sectional view on line 6-6 of FIG. 2.
Figure 7:
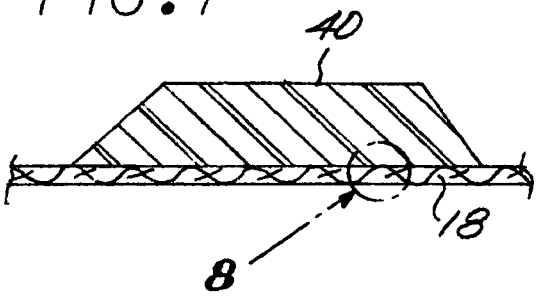
FIG. 7 is a cross-sectional view on line 7-7 of FIG. 2.
Figure 8:
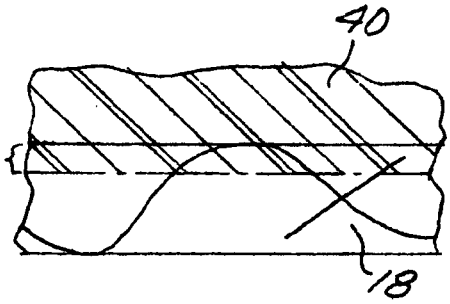
FIG. 8 is an enlarged area from FIG. 6 indicated by arrow 8 to show how the plastic projection on the glove penetrates into the fabric of the glove.
Figure 9:
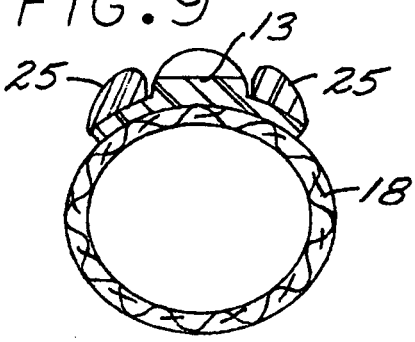
FIG. 9 is a cross-sectional view on line 9-9 of FIG. 2.
Figure 10:
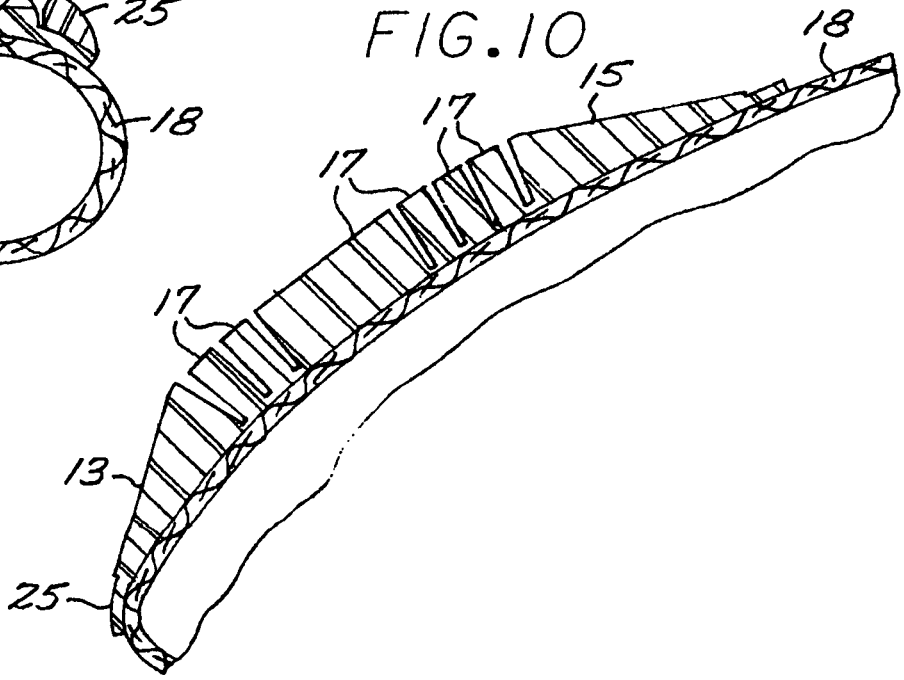
FIG. 10 is a cross-sectional view taken on the same line as FIG. 6 illustrating when the finger of the glove when the finger is bent.
Figure 11:
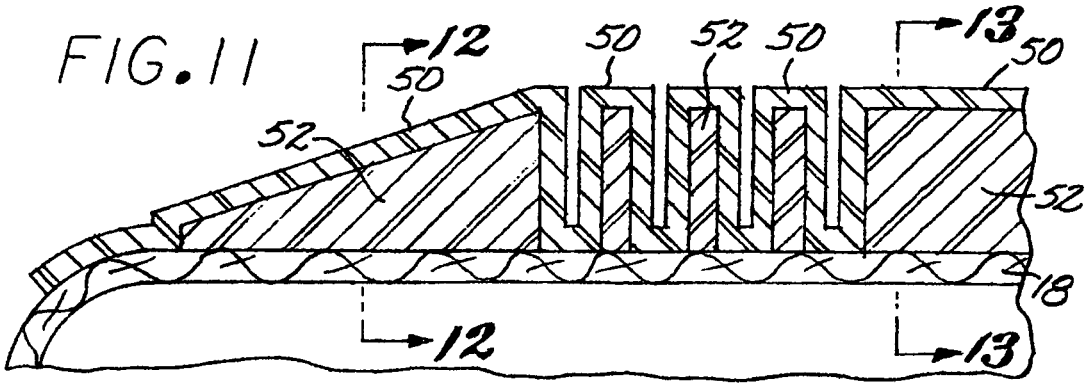
FIGS. 11-15 illustrate an alternate construction of the protective members on the dorsal side of the glove of the present invention.
Figure 12:
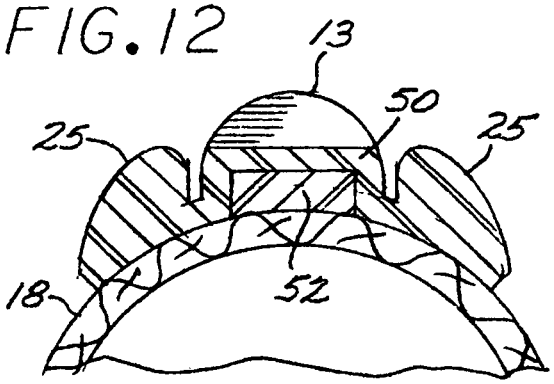
Figure 13:
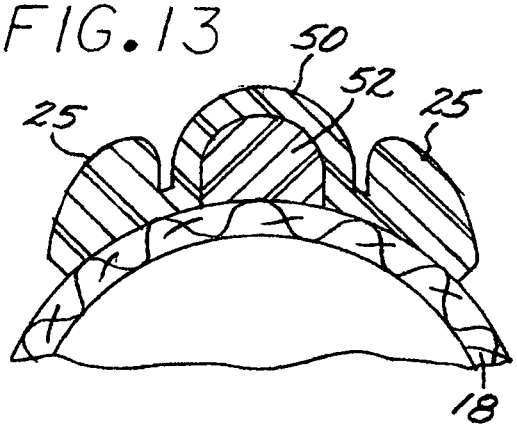
Figure 14:
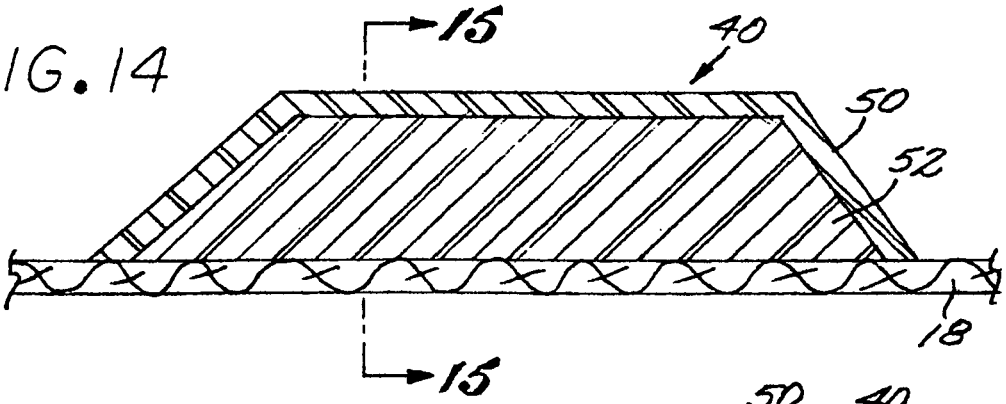
Figure 15:
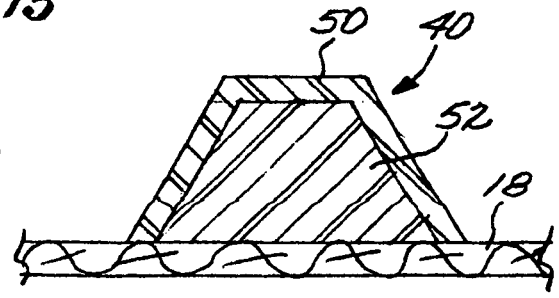

It should be noted that the protective members 12, 40 and 43 as shown in FIGS. 2 and 3 have spacing between them at specific locations along the length of the bones of the fingers to allow for fabric bunching and flexing. Typical spacing (reference letters a and b) between the protective members 15, 43 and 46 range from about 2 mm to about 18 mm (note that dimensions a and b can be equal, a can be greater than b or a can be less than b). Examples of specific locations of these spaces are as follows:

1. Spaces located proximal to the metacarpo-phalangeal joints, over the metacarpals of the four fingers, excluding the thumb.
2. Located distal of the metacarpophalangeal joints, over the proximal phalanges, of the four fingers, excluding the thumb.
3. Located proximal to the metacarpophalangeal joints, over the metacarpals, and distal of the metacarpophalangeal joints, over the proximal phalanges, of the four fingers (to allow for fabric bunching over the metacarpophalangeal joints, specifically when the metacarpals and proximal phalanges are in complete extension.)
4. Located at the distal interphalangeal joints, proximal interphalangeal joints or the metacarpophalangeal joints, or a combination thereof.

The protective members 12, 22, 40 and 43 can be fabricated from:

1. Polymers, rubber, silicone, plastic, gel, foam, metal, glass fibers, glass beads, carbon, high strength fibers, viscoelastic polymers or a combination thereof;
2. Oil resistant polymers; and
3. Thermoplastic elastomeric material with a hardness range of 30 Shore A to 45 Shore D.

As shown in FIGS. 11-15, protective members 12, 22, 40 and 43 may comprise separate upper (outer) layer 50 and lower (inner) layer 52, the layer 50 being harder than layer 52. The hard upper layer 50 protects from direct impacts to the back of the hand, and distributes the impact over a larger surface area reducing localized pressure (force per area). The softer lower layer 52 absorbs and redirects a portion of the impact laterally, away from the hand.

Layer 50 has a hardness in the range between 70 shore A to 50 shore D, layer 52 having a hardness in the range between shore A to 50 shore A.

Protective members 12, 22, 40 and 43 are adhered to the glove surface through stitching, heat application, sonic welding, or other known methods, or a combination thereof, and may be adhered to the glove surface such that no stitching is exposed on the surface of the glove. An alternate design does not expose the glove material at the distal phalanges, proximal phalanges and intermediate phalanges.

Examples of the glove material beneath the protective members 12, 22, 40 and 43 are woven fabric, non-woven fabric, natural or synthetic leather, fire resistant fabric, or cut resistant fabric.

While the invention has been described with reference to its preferred embodiments, it will be understood by those skilled in the art that various changes may be made and equivalents may be substituted for elements thereof without departing from the true spirit and scope of the invention. In addition, many modifications may be made to adapt a particular situation or material to the teachings of the invention without departing from its essential teachings.

What is claimed is:

1. A glove comprising:

a glove back;

a glove palm;

said glove palm joined to a glove back to form the glove, said glove having fingers and a thumb, said fingers and thumb having tip portions associated therewith; a plurality of base members secured to said glove back extending along a substantial length of the fingers and thumb, each of such base members including a proximal end, intermediate portion, and distal end, with an outer periphery extending along the perimeter of the base member; the distal end of each base member extending over the tip portions of the fingers and thumb;

an elongated protective member fixedly secured to each of said base members extending substantially along the length and width of each base members but recessed from the outer periphery of the base member, said protective members including a proximal end, an intermediate portion and a distal end adapted to cover proximal phalanges, intermediate phalanges and distal phalanges of the fingers and thumb of a person wearing said glove, said portions of the protective members adapted to cover the distal phalanges sloping downward to the distal end of each of said base members and extending to the tip portions of the fingers and thumb; said portions of the protective members adapted to cover sides of the distal phalanges sloping laterally and extending to a point recessed from the outer periphery of each of said base members.

2. The glove of claim 1 further including a plurality of protective members that are adapted to cover portions of metacarpal bones of the wearer.

3. The glove of claim 2 wherein said plurality of protective members extend above an upper surface of the glove back to a height in the range between 2 mm and 15 mm.

4. The glove of claim 1 wherein the protective members covering the proximal phalanges slope downward toward the proximal end of each base member.

5. The glove of claim 4 further including a plurality of protective members fixedly attached to the glove back that are adapted to cover portions of the metacarpal bones of the wearer.

6. The glove of claim 1 wherein said plurality of protective members comprise materials selected from the group consisting of polymers, foam, rubber, fiberglass and thermoplastic elastomeric material.

7. The glove of claim 1 wherein said plurality of protective members comprise thermoplastic elastomer with a hardness in the range between 30 Shore A and 45 Shore D.

8. The claim of a glove 1 wherein said plurality of protective members comprise separate upper and lower layers, said upper layer having a higher durometer than said lower layer.

9. The glove of claim 8 wherein said upper layer has a hardness in the range between 70 Shore A and 50 Shore D and wherein said lower layer has a hardness in the range between 0 Shore A and substantially 50 Shore A.

* * * * *